US007647750B2

(12) United States Patent
Kusui et al.

(10) Patent No.: US 7,647,750 B2
(45) Date of Patent: Jan. 19, 2010

(54) WRAPPING MEMBER ATTACHING METHOD AND WRAPPING MEMBER ATTACHING DEVICE

(75) Inventors: Yasuyuki Kusui, Takatsuki (JP); Hiroshi Yamada, Kyoto (JP); Naoko Tanase, Tokyo (JP)

(73) Assignee: Suntory Holdings Limited, Osaka-shi, Osaka (JP)

( * ) Notice: Subject to any disclaimer, the term of this patent is extended or adjusted under 35 U.S.C. 154(b) by 108 days.

(21) Appl. No.: 11/918,170

(22) PCT Filed: Apr. 6, 2006

(86) PCT No.: PCT/JP2006/307789

§ 371 (c)(1),
(2), (4) Date: Oct. 10, 2007

(87) PCT Pub. No.: WO2006/112341

PCT Pub. Date: Oct. 26, 2006

(65) Prior Publication Data

US 2009/0038268 A1 Feb. 12, 2009

(30) Foreign Application Priority Data

Apr. 13, 2005 (JP) ..... 2005-115877

(51) Int. Cl.
*B65B 53/06* (2006.01)

(52) U.S. Cl. ..... 53/442; 53/557

(58) Field of Classification Search ..... 53/442, 53/477, 478, 485, 488, 137.1, 329.2, 557, 53/585; *B65B 53/06*
See application file for complete search history.

(56) References Cited

U.S. PATENT DOCUMENTS 2,328,845 A * 9/1943 Pike et al. ..... 53/442
2,790,286 A * 4/1957 Snyder ..... 53/442

(Continued)

FOREIGN PATENT DOCUMENTS

EP 0058602 B1 * 9/1984
GB 2145963 A * 4/1985 ..... 53/557

(Continued)

OTHER PUBLICATIONS

Japanese Notice of Reasons for Rejection mailed Dec. 18, 2007 issued in Japanese Patent Application No. 2005-115877 (including a partial translation thereof).

(Continued)

*Primary Examiner*—Stephen F Gerrity
(74) *Attorney, Agent, or Firm*—Drinker Biddle & Reath LLP

(57) ABSTRACT

A wrapping member attaching device for attaching a wrapping member to a container includes a container preheating device, a wrapping member arranging device, and a wrapping member heating device. Due to the foregoing, the wrapping member is attached to the container without being tilted, wrinkles and unevenness of color. The container preheating device may include a container rotating device.

8 Claims, 3 Drawing Sheets

U.S. PATENT DOCUMENTS

| | | | | | |
|---|---|---|---|---|---|
| 3,802,942 | A | * | 4/1974 | Amberg et al. | 156/443 |
| 3,873,655 | A | * | 3/1975 | Amberg et al. | 264/48 |
| 4,463,861 | A | * | 8/1984 | Tsubone et al. | 215/12.2 |
| 4,691,835 | A | * | 9/1987 | Mueller | 53/442 |
| 4,803,829 | A | * | 2/1989 | Scheidegger | 53/442 |
| 4,852,271 | A | * | 8/1989 | Heckman et al. | 34/105 |
| 5,403,635 | A | * | 4/1995 | Hoffman | 428/34.7 |
| 5,415,721 | A | * | 5/1995 | Nickey et al. | 156/447 |
| 5,654,022 | A | * | 8/1997 | Sayre | 426/118 |
| 5,784,864 | A | | 7/1998 | Laury | |

FOREIGN PATENT DOCUMENTS

| | | | | | |
|---|---|---|---|---|---|
| JP | 63-33236 | | 2/1988 | | |
| JP | 01-144307 | | 10/1989 | | |
| JP | 01258939 | A | * 10/1989 | | 156/84 |
| JP | 01316248 | A | * 12/1989 | | |
| JP | 04311434 | A | * 11/1992 | | 53/442 |
| JP | 7-156928 | | 6/1995 | | |
| JP | 10-503453 | | 3/1998 | | |
| JP | 2003-291926 | | 10/2003 | | |
| JP | 2004-35029 | | 2/2004 | | |

OTHER PUBLICATIONS

Japanese Notice of Reasons for Rejection mailed May 7, 2008 issued in Japanese Patent Application No. 2005-115877 (including a partial translation thereof).

* cited by examiner

WRAPPING MEMBER ATTACHING METHOD AND WRAPPING MEMBER ATTACHING DEVICE

CROSS REFERENCE TO RELATED APPLICATIONS

This application is the National Stage of International Application No. PCT/JP2006/307789 filed Apr. 6, 2006, and claims benefit of Japanese Application No. 2005-115877 filed Apr. 13, 2005.

TECHNICAL FIELD

The present invention relates to a wrapping member attaching method for attaching a wrapping member such as a cap seal or a shrink label to a container. The present invention also relates to a wrapping member attaching device for executing this wrapping member attaching method.

BACKGROUND ART

Conventionally in order to enhance the sealing property of a mouthpiece of a container, prevent foreign objects from attaching to the mouthpiece of the container, ensure safety of the contents in the container in the case where the seal is broken by somebody, a wrapping member such as a cap seal or a shrink label is attached to a mouthpiece of a container having a cap.

In the case of attaching the wrapping member to the container, the mouthpiece of the container having the cap is surrounded by a cylindrical wrapping member, the size of which is slightly larger than that of the mouthpiece of the container. Then, the wrapping member is shrunk in the radial direction by heating so that the cylindrical wrapping member can be tightly contacted with an outer circumferential face of the mouthpiece of the container.

At the time of heating the wrapping member, a hot air type heating device for blowing hot air onto the wrapping member is widely used. For example, according to the hot air type heating device disclosed in Japanese Unexamined Patent Publication No. 2003-291926, a container surrounded by a wrapping member is made to pass through a tunnel-shaped heating chamber so as to preheat the wrapping member in the heating chamber. After that, a hot air of a predetermined temperature is blown to the wrapping member, so that the wrapping member can be shrunk by heat shrinkage. For details, refer to Japanese Unexamined Patent Publication No. 2003-291926.

However, the hot air type heating device of the related art, which is disclosed in Japanese Unexamined Patent Publication No. 2003-291926, is disadvantageous in that it is difficult to uniformly shrink the wrapping member in the circumferential direction. As a result, the wrapping member is attached to a mouthpiece of a container while being inclined in some cases. Alternatively, wrinkles or color unevenness is caused in the wrapping member after it has been attached to the mouthpiece of the container.

Recently, it is common to use a wrapping member, the length in the longitudinal direction of the container of which is relatively long. Further, it is common to use a wrapping member such as a cap seal or a shrink label on which letters or pictures are printed. Accordingly, the wrapping member is attached to the mouthpiece while being inclined or it wrinkles and/or color unevenness is caused in the wrapping member, information included in the design of the wrapping member cannot be accurately notified to a consumer, which affects sales of the containers to which the above wrapping member is attached.

In the case where the container and the wrapping member are gradually heated while suppressing a rise in the temperature per unit time, it is possible to prevent a wrapping member from being tilted when it is attached to the container. Further, it is possible to prevent the generation of wrinkles and/or color unevenness. However, in this case, it is necessary to extend the length of a conveyor for conveying the containers at the time of heating. Alternatively, it is necessary to reduce a conveyance speed of conveying the containers by the conveyor. Therefore, additional expenses are required or throughput will be lowered, which are not preferable.

The present inventors made investigations into the cause of the generation of wrinkles and color unevenness on the wrapping member after the wrapping member has been attached to the mouthpiece of the container. As a result of their investigations, the present inventors obtained the following knowledge. In the related art, the container and the wrapping member are simultaneously heated by the hot air type heating device. Therefore, at the time of heating, heat is mainly absorbed by the container and a hot air is blown to the wrapping member only in one direction or only in a plurality of directions. Thus, it is difficult to uniformly heat the wrapping member in the circumferential direction. Due to this, wrinkles and color unevenness are caused. According to the above knowledge, the present inventors investigated and obtained knowledge in which the above problems can be solved by preheating the container and then attaching the wrapping member to the preheated container, and accordingly, the present invention has been accomplished. In other words, the present invention has been accomplished in view of the above circumstances. An object of the present invention is to provide a wrapping member attaching method capable of attaching a wrapping member to a container without causing an inclination attaching of the wrapping member and without generating wrinkles and/or color unevenness on the wrapping member. Another object of the present invention is to provide a wrapping member attaching device for executing the wrapping member attaching method.

DISCLOSURE OF THE INVENTION

In order to accomplish the above object, according to the first aspect, a wrapping member attaching method for attaching a wrapping member to a container comprises the steps of: preheating at least a portion of the container; surrounding the container with the wrapping member; and heating the wrapping member at a temperature not less than a shrinkage starting temperature of the wrapping member so as to shrink the wrapping member around the container and attach the wrapping member to the container.

In the first aspect, before the container is surrounded by the wrapping member such as a cap seal or a shrink label, the container is previously heated (preheated). Accordingly, when the wrapping member surrounds the container, the wrapping member is preshrunk from its inner face by a temperature of the surface of the container. Since the container is preheated, at the time of heating the wrapping member, heat is not absorbed by the container and the wrapping member starts shrinking from its preshrinking portion. Therefore, the wrapping member is uniformly shrunk. Accordingly, the wrapping member can be prevented from attaching to the container while being tilted. Further, the generation of wrinkles and color unevenness can be prevented.

According to the second aspect, as in the first aspect, the container is preferably preheated to a temperature close to the shrinkage starting temperature of the wrapping member.

That is, according to the second aspect, the wrapping member can be preliminarily shrunk and tightly contacted with an outer face of the container. For example, a preferable shrinkage starting temperature can be not less than 70° C.

According to the third aspect, as in the first or the second aspect, the container preferably includes a large diameter portion, the diameter of which is larger than a diameter of a mouthpiece of the container, arranged in a lower portion of the mouthpiece, and a lower edge portion of the wrapping member extends to the large diameter portion.

In the third aspect, when the wrapping member surrounds the container, a lower edge portion of the wrapping member coming into contact with the large diameter portion of the container is preliminarily shrunk and tightly contacted with the container. Therefore, when the wrapping member is heated, it is uniformly shrunk along an outer face of the container from the tightly contacting portion. Further, the wrapping member can be attached to the container without being tilted with respect to the mouthpiece of the container.

According to the fourth aspect, as in any one of the first to the third aspects, a portion of the container corresponding to a portion of the wrapping member which shrinks the most is preferably preheated.

In the fourth aspect, when only the corresponding portion of the container, that is, only the lower portion of the mouthpiece of the container is heated, other portions of the container covered with the wrapping member are heated by the heat conduction. Therefore, energy required for heating can be reduced. In this case, for example, it is preferable that the container be made of glass.

In the fifth aspect, as in one of the first to the fourth aspect, the container is preferably rotated when it is preheated.

In the fifth aspect, by rotating the container in the circumferential direction, it is possible to preheat the container uniformly in the circumferential direction.

According to the sixth aspect, a wrapping member attaching device for attaching a wrapping member to a container comprises: a container preheating means for preheating at least a portion of the container; a wrapping member arranging means for arranging the wrapping member in such a member that the container can be surrounded by the wrapping member; and a wrapping member heating means for heating the wrapping member to a temperature not less than a shrinkage starting temperature of the wrapping member so that the wrapping member can be shrunk around the container and attached to it.

In the sixth aspect, before the container is surrounded by the wrapping member such as a cap seal or a shrink label, the container is previously heated (preheated). Accordingly, when the wrapping member surrounds the container, the wrapping member is preliminarily shrunk from its inner face by a temperature of the surface of the container. Since the container is preheated, when the wrapping member is heated, heat is not absorbed by the container and the wrapping member starts shrinking from the preliminarily shrinking portion. Therefore, the wrapping member is uniformly shrunk. Accordingly, the wrapping member can be prevented from attaching to the container while being tilted. Further, the generation of wrinkles and unevenness of color can be prevented.

In the seventh aspect, as in the sixth aspect, the container preheating means preferably includes a container rotating means for rotating the container.

In the seventh aspect, by rotating the container in the circumferential direction, the container can be preheated uniformly in the circumferential direction. For example, it is preferable that the container rotating means includes a rubber plate arranged being inclined with respect to the conveyance direction of the conveyor for conveying the containers. Due to the foregoing, the container rotating means can be simply formed at a low manufacturing cost.

According to the eighth aspect, as in the sixth or the seventh aspect, a wrapping member attaching device preferably further comprises a self-cooling suppressing means for suppressing the container, which has been preheated by the container preheating means, from being self-cooled between the container preheating means and the wrapping member heating means.

In the eighth aspect, a container preheated by the container preheating means is conveyed to the wrapping member heating means without being self-cooled. Therefore, the wrapping member can be maintained at a temperature necessary for preshrinkage. Further, an intensity of energy consumed by the wrapping member heating means can be suppressed. The self-cooling suppressing means may be a tunnel-shaped member for connecting the container preheating means with the wrapping member heating means.

According to the ninth aspect, as in any one of the sixth to the eighth aspect, the container preheating means and/or the wrapping member heating means is preferably a steam type heating device.

In the ninth aspect, a container can be gradually heated. Therefore, the entire container and/or the entire wrapping member can be more uniformly heated.

According to the tenth aspect, as in any one of the sixth to the eighth aspects, the container preheating means and/or the wrapping member heating means is preferably a hot air type heating device.

In the tenth aspect, even when a label made of paper is stuck onto a container, it is possible to selectively blow hot air to a portion of the container where a label made of paper does not exist. Therefore, the label made of paper can be prevented from being damaged.

According to the aspect described above, the following advantages can be provided. It is possible to attach a wrapping member to a container without being tilted and without generating wrinkles and/or color unevenness on the wrapping member.

Further, according to the second aspect, it is possible to provide an advantage in which a wrapping member is preshrunk and tightly contacted with an outer face of a container.

Furthermore, according to the third aspect, the following advantages can be provided. Since a lower edge portion of the wrapping member coming into contact with the large diameter portion of the container is preshrunk and tightly contacted with the container, at the time of heating the wrapping member, the wrapping member can be uniformly shrunk from the tightly contacting portion along an outer face of the container. Furthermore, the wrapping member can be attached to the container without being tilted with respect to the mouthpiece of the container.

According to the fourth aspect, it is possible to provide an advantage in which energy necessary for heating can be reduced.

According to the fifth aspect, it is possible to provide an advantage in which the container can be preheated uniformly in the circumferential direction.

According to the seventh aspect, it is possible to provide an advantage in which the container can be preheated uniformly in the circumferential direction.

According to the eighth aspect, it is possible to provide an advantage in which the wrapping member can be maintained at a temperature necessary for preshrinking.

According to the ninth aspect, it is possible to provide an advantage in which the entire container and/or the entire wrapping member can be more uniformly heated.

According to the tenth aspect, it is possible to provide an advantage in which a label made of paper can be prevented from being damaged.

From the following detailed explanations of the typical embodiment of the present invention shown in the accompanying drawings, objects, characteristics and advantages of the present invention and other objects, characteristics and advantages will become more apparent.

BEST MODE FOR CARRYING OUT THE INVENTION

Figure 1:
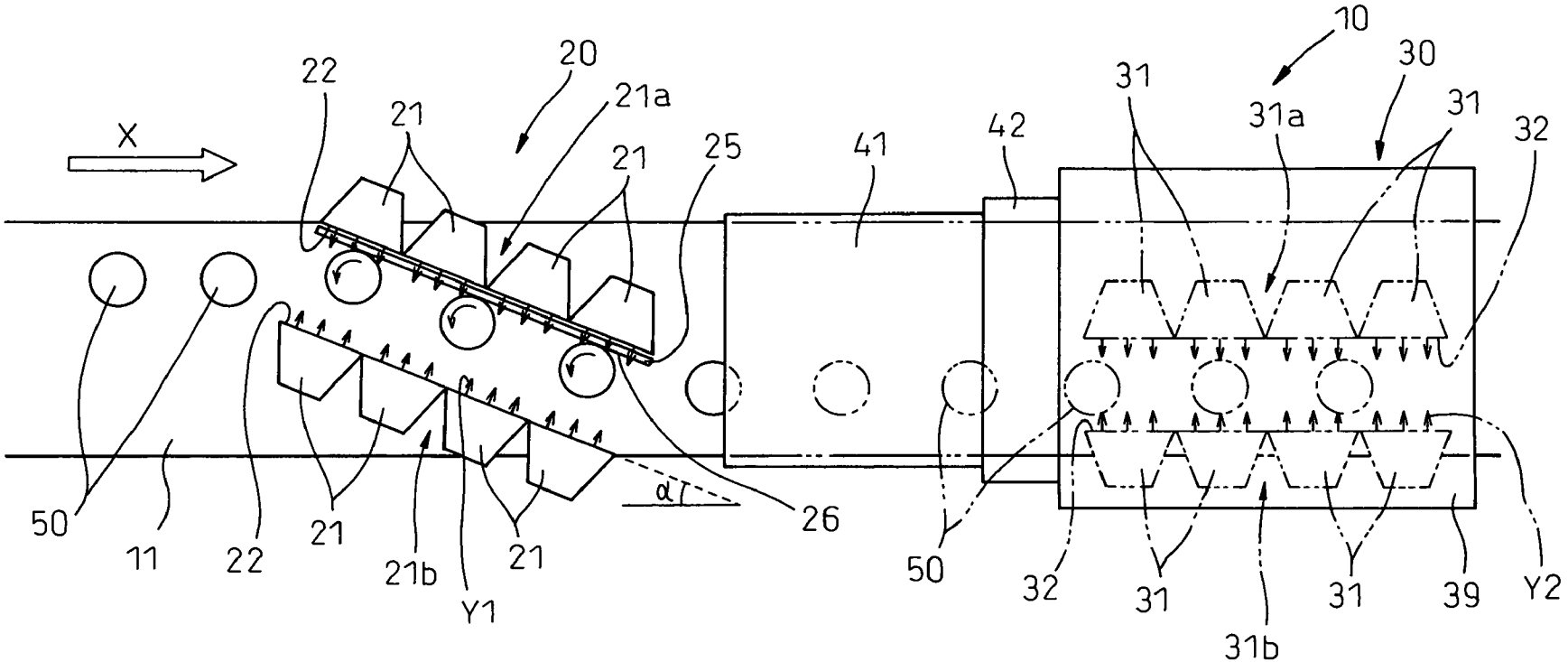
FIG. 1 is a schematic diagram showing a wrapping member attaching device of the present invention.

Referring to the accompanying drawings, an embodiment of the present invention will be explained below. In the drawings, like reference marks are used throughout to designate identical elements. In order to facilitate understanding, the scale of these drawings has been appropriately reduced.

FIG. 1 is a schematic diagram showing a wrapping member attaching device of the present invention. A wrapping member attaching device 10 shown in FIG. 1 includes a conveyor 11 for successively conveying a plurality of containers 50 in the arrowed direction X at a predetermined speed. As shown in the drawing, there are provided a container preheating station 20, a wrapping member arranging station 41 and a wrapping member heating station 30, which are arranged in this order from the upstream side to the downstream side of the flow of the containers 50 in the conveyor 11.

In the present invention, the container 50 is a glass bottle having a cap 55 filled with contents, for example, the container 50 is a foreign liquor bottle. However, the container 50 may be a bottle made of other materials, for example plastic material such as PET (polyethylene terephthalate). In this case, the bottle is also filled with contents and provided with the cap 55.

The container preheating station 20 includes a plurality of hot air machines 21 capable of blowing out hot air from a blowout face 22 by a known method. For example, the hot air machine 21 shown in FIG. 1 is a hot air machine available from Leister Process Technologies Co. As shown in the drawing, four hot air machines 21, which are arranged being adjacent to each other in such a manner that each of the blowout faces 22 can be located on the same plane, compose a hot air machine assembly 21*a*. Another hot air machine assembly 21*b*, which has four hot air machines 21 arranged in the same manner, is arranged in parallel with the hot air machine 21*a* being opposed to it. As shown in the drawing, a gap formed between these hot air machine assembly bodies 21*a* and 21*b* is larger than a diameter of the container 50. Further, the hot air machine assemblies 21*a*, 21*b* are arranged in such a manner that this gap can be located in a region of the conveyor 11. As can be seen from FIG. 1, these hot air machine assemblies 21*a*, 21*b* are not arranged in parallel with the conveyance direction X of the conveyor 11 but arranged being inclined so that the hot air machine assemblies 21*a*, 21*b* can form a predetermined angle $\alpha$ with respect to the conveyance direction X.

One hot air machine assembly 21*a*, which is arranged in such a manner that a portion of the blowout face 22 can be seen from the upstream side of the conveyor 11, includes a contact member 25 which is arranged being adjacent to the common blowout face 22. Accordingly, the contact member 25 is also arranged being inclined with respect to the conveyor 11 by the predetermined angle $\alpha$ with respect to the conveyance direction X. The contact member 25 is arranged while avoiding the blowout face 22 of the hot air machine assembly 21*a* in such a manner that almost all the hot air blown out from the blowout face 22 can pass through the contact member 25. That is, even when the contact member 25 is arranged, a hot air blowing action of the hot air machine 21 is seldom affected. In this connection, the contact member 25 may be composed in such a manner that a plurality of holes are formed in the contact member 25 so that almost all the hot air blown out form the blowout face 22 of the hot air machine assembly 21*a* can pass through the holes.

It is preferable that the surface roughness of a surface 26 of the contact member 25, which is located on the opposite side to the blowout face 22, is relatively high. Due to this, the container 50, which has collided with the contact member 25, can be easily rotated as described later. Accordingly, it is preferable that the contact member 25 is made of, for example, rubber. In this case, it is possible to prevent the container 50 from being damaged at the time of collision of the container described later. In this connection, the contact member 25 may be composed in such a manner that a rubber film is stuck onto the surface 26 of a metallic plate.

The wrapping member arranging station 41, which is arranged in the downstream of the container preheating station 20, is formed into a tunnel-shape with respect to the conveyor 11. In the wrapping member arranging station 41, the wrapping member 60 such as a cap seal or a shrink label can surround the periphery of a mouthpiece 51 of the container 50 by a known method. The wrapping member 60 is a substantially cylindrical member formed by joining both end portions of a film to each other. The wrapping member 60 is made of plastic material such as PET or biaxial oriented polystyrene (OPS (registered trade mark)). Usually, a design such as letters or pictures is made on the wrapping member 60.

Figure 2:
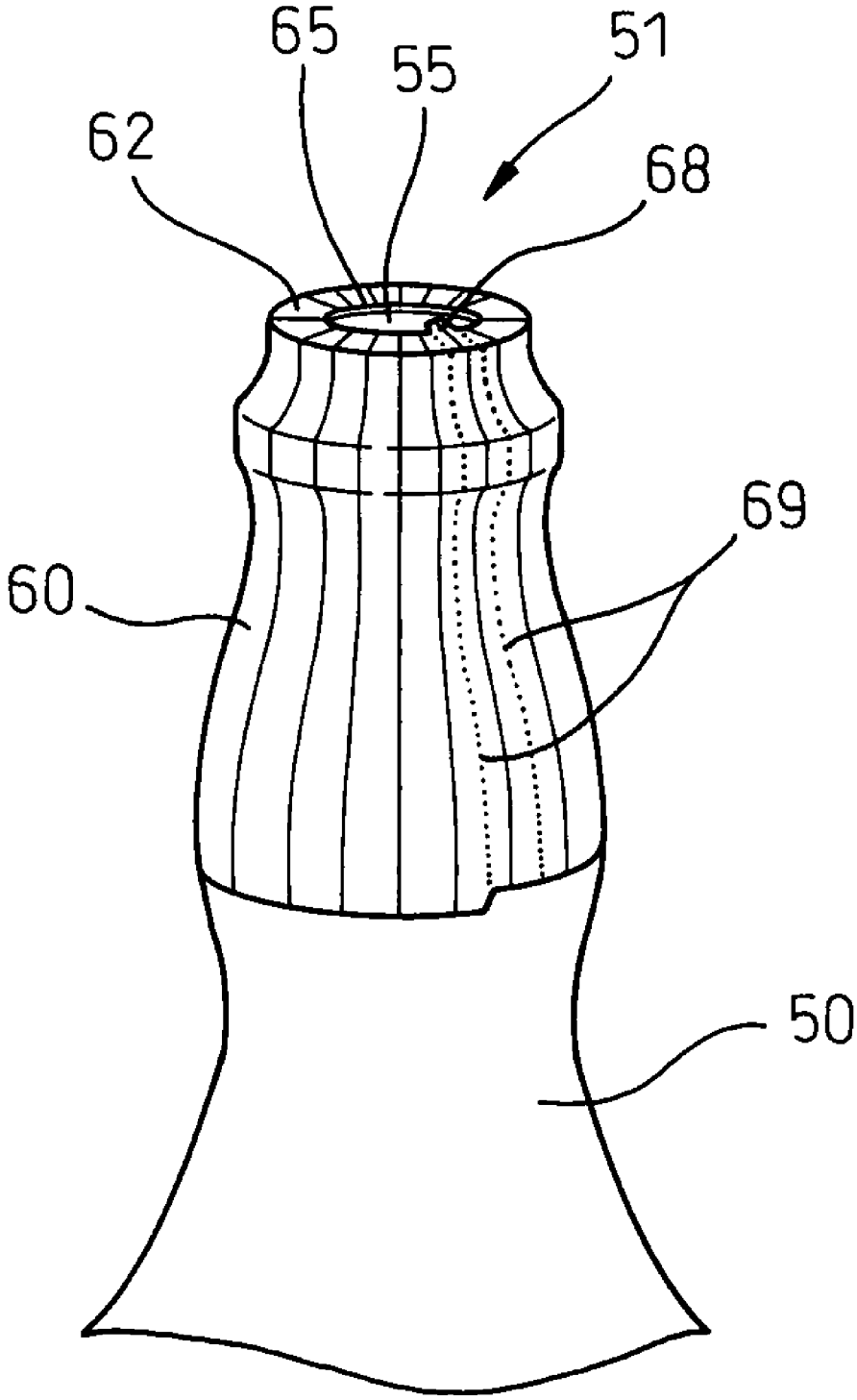
FIG. 2 is a view showing a wrapping member attached round a mouthpiece of a container.

FIG. 2 is a view showing a wrapping member attached to the mouthpiece of the container by means of heat shrinkage. It should be noted that a shape of the wrapping member 60 shown in FIG. 2 is different from the shape of the wrapping member 60 supplied round the mouthpiece 51 of the container 50 in the wrapping member arranging station 41. The wrapping member 60, the shape of which is substantially cylindrical at the time of surrounding, has an annular top portion 62 provided with an opening portion 65. On an circumferential face 61 of the wrapping member 60, two perforated lines 69 extending in the longitudinal direction are formed, and end at a flap 68 extending into the opening portion 65 of the annular top portion 62. An inner diameter of the substantially cylindrical wrapping member 60 is slightly larger than an outer diameter of the corresponding container 50.

Referring again to FIG. 1, in the downstream of the wrapping member arranging station 41, the wrapping member heating station 30 is arranged. A heating hood 42, which is formed into a tunnel-shape with respect to the conveyor 11, connects the wrapping member arranging station 41 with the wrapping member heating station 30. The wrapping member heating station 30 is also provided with the similar tunnel-shaped heating hood 39. In the tunnel-shaped heating hood 39, two hot air machine assemblies 31*a*, 31*b* are arranged. In the same manner as that of the hot air machine assemblies 21*a*, 21*b* of the container preheating station 20, each of the hot air machine assemblies 31*a*, 31*b* includes four hot air machines 31. These hot air machines 31 are arranged in such a manner that the respective blowout faces 32 can be opposed to each other. As can be seen from FIG. 1, the blowout faces 32 of the respective hot air machines 31 of the hot air machine assemblies 31*a*, 31*b* are parallel with the conveyance direction X. In this way, in the present invention, the hot air machines 21 and 31 are used in both the container preheating station 20 and the wrapping member heating station 30. Therefore, even in the case where a label (not shown) made of paper is stuck on the container 50, it is possible to prevent the label made of paper from being damaged, by selectively heating a position of the container except for the label made of paper.

Figure 3A:
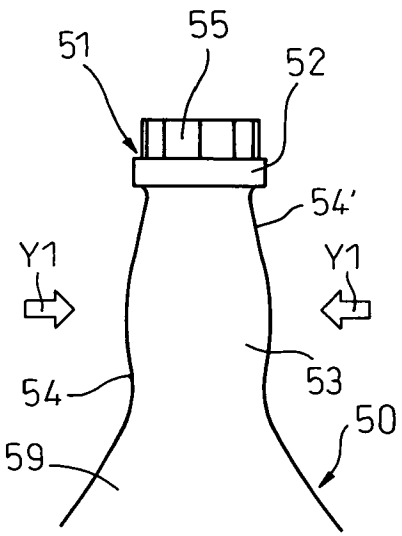
FIG. 3*a* is a partially enlarged view showing a container in a state in which a hot air is blown to the container.

At the time of operating the wrapping member attaching device 10 of the present invention, the conveyor 11 of the wrapping member attaching device 10 is driven. In addition, the hot air machines 21 of the container preheating station 20 and the hot air machines 31 of the wrapping member heating station 30 are set in motion. The containers 50 are successively supplied to the conveyor 11 at predetermined intervals by a supply device not shown. Each container 50 is filled with contents. As shown in FIG. 3*a* which is a partially enlarged view of the container 50, the cap 55 has already been capped to a bead 52 of the mouthpiece 51. In addition, as shown in FIG. 3*a* and others, the container 50 has a large diameter portion 53, the diameter of which is larger than that of the bead 52, arranged in a lower portion of the bead 52. Between the bead 52 and the large diameter portion 53, a small diameter portion 54', the diameter of which is smaller than that of the large diameter portion 53, is arranged. Further, the large diameter portion 53 continues to another small diameter portion 54, the diameter of which is small than that of the large diameter portion 53. The small diameter portion 54 continues to a barrel portion 59 of the container 50.

As shown in FIG. 1, the container 50 is supplied to a position corresponding to the gap on the upstream side between the hot air machine assemblies 21*a*, 21*b*. Therefore, the container 50 enters this gap and hot air from the hot air machines 21 of the hot air machine assemblies 21*a*, 21*b* are blown onto both sides of the container 50. As shown in FIG. 3*a*, hot air Y1 from the hot air machine 21 is blown to the large diameter portion 53 in the height of the container 50. However, as described later, the hot air Y1 may be blown out to the small diameter portion 54' between the bead 52 and the large diameter portion 53. In this case, the blowing position of the hot air Y1 can be changed by adjusting height positions of the hot air machine assemblies 21*a*, 21*b*. In this connection, the setting temperature of the hot air machine 21 is sufficiently high for preshrinking the wrapping member 60 as described later. The container 50 is preheated, for example, at a temperature not less than 40° C. In this connection, the container 50 may be preheated at the shrinkage starting temperature, for example, at 70° C.

In this connection, as can be seen from FIG. 1, the container 50, which has entered the gap between the hot air machine assemblies 21*a*, 21*b*, collides with the contact member 25. As described before, the contact member 25 is arranged so that the angle α can be formed between the contact member 25 and the conveyor 11. Accordingly, when the conveyor 11 continues to operate, as can be seen from the drawing, while the container 50 colliding with the contact member 25 is rotating in the circumferential direction, it can be conveyed along the contact member 25. In this case, when the hot air Y1 are blown out to the container 50 from both sides of the hot air machine assemblies 21*a*, 21*b*, the container 50 can be uniformly preheated in the circumferential direction. Therefore, the predetermined angle α shown in FIG. 1 is an angle capable of rotating the container 50 by a predetermined conveyance speed of the conveyor 11. Since the hot air machine 21 blows out a hot air in one direction or in a plurality of directions, it is usually difficult that an object to be heated is uniformly heated in the circumferential direction by the hot air machine 21. However, in the present invention, the container 50 is rotated in the circumferential direction. Accordingly, even when the hot air machine 21 is used, it is possible to uniformly heat (preheat) the container 50 in the circumferential direction.

Then, the container 50, which has been preheated by the container preheating station 20, flows out from the gap on the downstream side between the hot air machine assemblies 21*a*, 21*b* and enters the wrapping member arranging station 41. In the wrapping member arranging station 41, the wrapping member 60 is inserted to the mouthpiece 51 of the container 50. Therefore, the wrapping member 60 is arranged in such a manner that it surrounds the mouthpiece 51 of the container 50. At this time, an inner face of the annular top portion 62 engages with a top face of the cap 55. The above arrangement of the wrapping member 60 is known, and the explanation thereof is omitted here. As shown in the drawing, the maximum diameter of the substantially cylindrical wrapping member 60 is slightly larger than the diameter of the bead 52 of the mouthpiece 51, in this case, is slightly larger than the diameter of the large diameter portion 53. Accordingly, in a state in which the mouthpiece 51 of the container 50 is surrounded by the wrapping member 60, the wrapping member 60 inserts the mouthpiece 51 of the container 50 with a play.

Figure 3B:
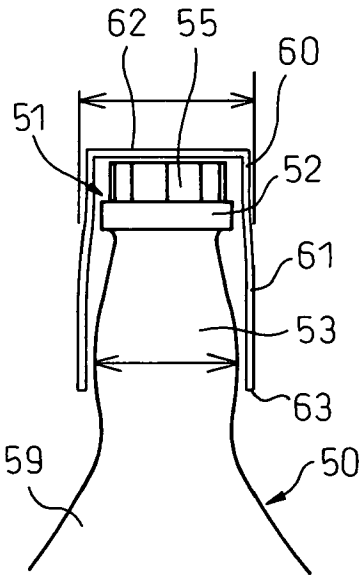
FIG. 3*b* is a partially enlarged view showing a container in a state in which a wrapping member surrounds a mouthpiece of the container.
Figure 3C:
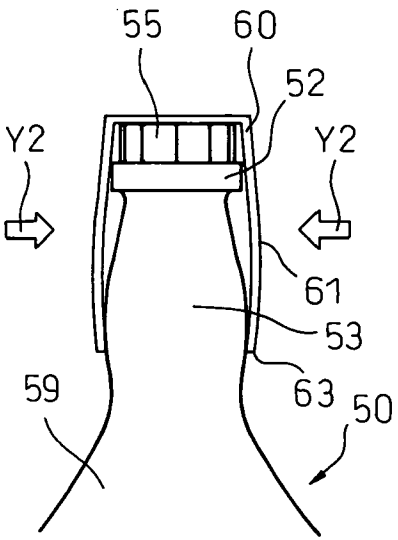
FIG. 3*c* is a partially enlarged view showing a container in a state in which a lower edge portion of a wrapping member is tightly contacted.

The container 50, especially the large diameter portion 53 of the container 50 is preheated by the container preheating station 20. Therefore, right after the wrapping member 60 has surrounded the mouthpiece 51 of the container 50 or after a predetermined period of time has passed from when the wrapping member 60 surrounded the mouthpiece 51 of the container 50, an inner face of the wrapping member 60 is shrunk (preshrunk) by the heat transmitted from the container 50. In the case where the container 50 is preheated at a temperature not less than the shrinkage starting temperature of the wrapping member 60, for example 70° C., the wrapping member 60 tightly comes into contact with the container 50 by this preshrinkage. FIG. 3*c* is a partially enlarged view showing a container in a state in which a lower edge portion of the wrapping member tightly comes into contact with the container. In the embodiment shown in FIGS. 3*b* and 3*c*, a gap between the circumferential face 61 of the wrapping member 60 and the container 50 is the smallest at the lower edge portion 63 of the circumferential face 61 and the large diameter portion 53. Therefore, the lower edge portion 63 of the wrapping member 60 tightly comes into contact with the large diameter portion 53 of the container 50 by the preshrinkage. In the present invention, the container 50 is uniformly preheated in the circumferential direction by the container preheating station 20. Therefore, the wrapping member 60 is also uniformly, preshrunk in the circumferential direction and tightly comes into contact with the container 50.

In the embodiment shown in the drawing, the lower edge portion 63 of the wrapping member 60 first tightly comes into contact with the container 50. That is, right after the annular top portion 62 has engaged with a top face of the cap 55, the lower edge portion 63 of the wrapping member 60 preshrinks and starts tightly coming into contact with the container. Therefore, the lower edge portion 63 of the wrapping member 60 tightly comes into contact with the container 50 at a desired horizontal position. In this case, when the wrapping member 60 is attached to the container 50 in the wrapping member heating station 30 described later, it is possible to prevent an inclination attaching of the wrapping member 60 to the container 50.

In the present embodiment, the large diameter portion 53 of the container 50 is preheated by the container preheating station 20. However, a portion of the container corresponding to the portion of the wrapping member 60, the shrinkage of which is the largest, may be preheated, for example, the small diameter portion 54' may be preheated. In the embodiment shown in the drawing, the small diameter portion 54' and the large diameter portion 53 are adjacent to each other. Therefore, the heat generated at the time of preheating in the container preheating station 20 is transmitted from the small diameter portion 54' to the large diameter portion 53. Therefore, when the mouthpiece 51 of the container 50 is surrounded by the wrapping member 60, the wrapping member 60 tightly comes into contact with the container between the large diameter portion 53, the gap with the wrapping member 60 of which is the smallest, and the lower edge portion 63 in the same manner. In this case, a portion of the container 50, which is located at the most distant position from the contents in the container 50, is heated. Accordingly, there is no possibility that the contents in the container 50 are affected by heating. However, in the case where it is desired to quickly conduct the attaching operation for attaching the wrapping member to the container, it is preferable to preheat the large diameter portion 53, the gap with the wrapping member 60 of which is the smallest, by the container preheating station 20.

Then, the container 50, which has flowed out from the wrapping member arranging station 41, passes through the heating hood 42 and enters the heating hood 39 of the wrapping member heating station 30. The hot air machine assemblies 31*a*, 31*b* are arranged in such a manner that a gap between the hot air machine assemblies 31*a*, 31*b* can correspond to the gap on the downstream side between the hot air assemblies 21*a*, 21*b*. Accordingly, the container 50 passes through this gap without colliding with the hot air machine assemblies 31*a*, 31*b*. As shown in FIG. 3*c*, in the wrapping member heating station 30, the hot air Y2 sent from the hot air machine assemblies 31*a*, 31*b* are blown out to the small diameter portion 54' through the wrapping member 60. A temperature of the hot air Y2 is set at a value not less than the shrink starting temperature of the wrapping member 60. The wrapping member 60 is heated, for example, at 70° C. Due to this, the wrapping member 60 shrinks in the radial direction. As a result, an inner face of the circumferential face 61 of the wrapping member 60 tightly comes into contact with the circumferential face of the container 50.

Since the container 50 has already been preheated in the container preheating station 20, even in the case where the container 50 and the wrapping member 60 are heated by the hot air Y2, the heat of the hot air Y2 is seldom absorbed by the container 50. Namely, almost all of the heat of the hot air Y2 is used for shrinking the wrapping member 60. In the embodiment shown in the drawing, when the container flows into the wrapping member heating station 30, the lower edge portion 63 of the wrapping member 60 tightly comes into contact with the container 50. Further, the annular top portion 62 of the wrapping member 60 engages with a top face of the cap 55. Therefore, the air enclosed in the gap between the wrapping member 60 and the container 50 seldom flows outside. Accordingly, the air enclosed in the gap between the wrapping member 60 and the container 50 can be maintained to be relatively hot.

Figure 3D:
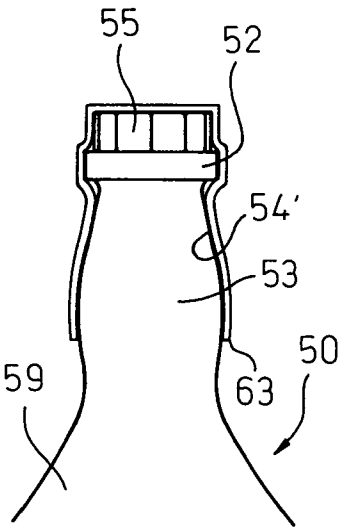
FIG. 3*d* is a partially enlarged view showing a container to which a wrapping member has been attached.

Therefore, when starting the heating operation heating in the wrapping member heating station 30, the wrapping member 60 starts shrinking from the tightly contacting portion with the container 50, that is, the wrapping member 60 starts shrinking from the lower edge portion 63. Since a temperature of the container 50 and a temperature of the air enclosed between the container 50 and the wrapping member 60 are relatively high, an inner face of the circumferential face 61 is easily shrunk in the radial direction and stuck onto the container 50. This shrinking operation in the radial direction proceeds upward from the lower edge portion 63 of the wrapping member 60. On the other hand, the air enclosed in the gap between the container 50 and the wrapping member 60 flows along the side of the container 50 and passes through a gap between the bead 52, the cap 55 and the wrapping member 60 and then flows outside from the opening portion 65. As a result, as shown in FIG. 3*d*, the wrapping member 60 can be attached to the container 50 without generating wrinkles and/or color unevenness.

In this connection, in order to prevent the generation of wrinkles and/or color unevenness, it is preferable that a temperature of the container 50 when entering the wrapping member heating station 30 is maintained relatively high. In order to do so, it is desirable that the container 50 is not self-cooled between the container preheating station 20 and the wrapping member heating station 30. In the present embodiment, the wrapping member arranging station 41 and the wrapping member heating station 30 are formed into a tunnel-shape. In addition to that, the heating hood 42 is arranged between the wrapping member arranging station 41 and the wrapping member heating station 30 so that the container 50 is prevented from self-cooling. By using the heating hood 42, the wrapping member 60 can be maintained at a temperature necessary for the preshrinkage. Further, it is possible to suppress heating energy which is necessary in the wrapping member heating station 30. Of course, the wrapping member arranging station 41 and the wrapping member heating station 31 may be directly connected to each other by extending the heating hood 39 of the wrapping member heating station 30 or the tunnel-shaped wrapping member arranging station 41, while the heating hood 42 is excluded. Further, the wrapping member arranging station 41 may not be formed into a tunnel-shape with respect to the conveyor 11.

As described above, according to the present invention, in the container preheating station 20, the wrapping member 60 is preshrunk by preheating the container 50 and the lower edge portion 63 of the wrapping member 60 is tightly contacted with the container 50 according to the preheating temperature. Then, in the wrapping member heating station 30, the wrapping member 60 and the container 50 are heated together, so that the wrapping member 60 can be shrunk and attached to the container 50. Accordingly, unlike the prior art, it is not necessary to extend a length of the conveyor for the containers in order to suppress a rise in the temperature per unit hour. Further, it is not necessary to reduce a conveyance speed for conveying containers on the conveyor. According to the present invention, without additional cost or a reduction of throughput, it is possible to prevent the wrapping member from being tilted. Further, it is also possible to prevent the generation of wrinkles and/or color unevenness.

In the embodiment explained before referring to the drawings, the hot air machines 21, 31 are respectively used for the preheating means and the heating means in the container preheating station 20 and the wrapping member heating station 30. However, other preheating means and heating means may be used. For example, a steam type preheating means and a steam type heating means may be used. In this case, it is possible to conduct so-called gradually heating. Therefore, the container 50 and/or the wrapping member 60 can be more uniformly heated.

In the embodiment described above, it is assumed that the wrapping member 60 is attached to the mouthpiece 51 of the container 50. However, even in the case where the wrapping member 60 is attached only to the barrel portion 59 of the container 50, the present invention can be applied. In this connection the present invention includes a case in which some of the embodiments described above are appropriately combined with each other.

The present invention has been explained above referring to typical embodiments. However, it should be noted that variations, omissions and additions can be made by those skilled in the art without departing from the scope of the present invention.

EXAMPLES

In the wrapping member attaching device 10 shown in FIG. 1, bottles for foreign liquors were used for the containers 50. Films, the thickness of which was 55 micrometers, made of polyethylene terephthalate (PET) and films, the thickness of which was 60 micrometers, made of biaxial oriented polystyrene (OPS (registered trade mark)) were used for the wrapping members 60. The wrapping members 60 were attached to the bottles.

After investigations into a heating position, a heating temperature of the container 50 in the container preheating station 20, and an investigation into whether or not the container was self-cooled, the results of them with respect to the sample numbers A to F are shown on Table 1.

On Table 1, a heating position of heating the container 50 is the small diameter portion 54' between the bead 52 and the large diameter portion 53. Alternatively, a heating position of heating the container 50 is the large diameter portion 53. The heating position is heated at 40° C. or 70° C. In table 1, "No existence of self-cooling" means a case in which the heating hood 42 exists and "Existence of self-cooling" means a case in which the heating hood 42 does not exist.

As shown on Table 1, as compared with the case of No. F in which the container 50 was not heated in the container preheating station 20, the cases of Nos. A to E in which the container 50 was heated show a good result (Good), that is, in the cases of Nos. A to E, no wrinkles etc., were generated.

In the case where the small diameter portion 54' was heated (Nos. A and B) or in the case where the large diameter portion 53 was heated at a relatively low temperature (40° C.) (No. C), a gap was generated between the lower edge portion 63 of the wrapping member 60 and the large diameter portion 53. On the other hand, in the case where the large diameter portion 53 was heated at a relatively high temperature (70° C.) (No. D), the lower edge portion 63 of the wrapping member 60 was tightly contacted with the large diameter portion 53 and no gap was formed. In the case where no gap was formed as described above, a good result (Good) was obtained, however, there was not a big difference with respect to the case in which a gap was formed (Nos. A to C).

In the case where the heating hood 42 was excluded and the container 50 was self-cooled (No. E), the result was inferior to that of the case in which the heating hood 42 was used and the container 50 was not self-cooled (No. D), that is, the result was Moderate. In this connection, on Table 1, no difference was made between the materials (PET and OPS) composing the wrapping member 60.

The invention claimed is:

1. A wrapping member attaching method for attaching a wrapping member to a container comprising the steps of:

conveying the container;

preheating the container in such a manner that the container collides with a contact means to rotate the container in a circumferential direction while entering a gap between a first and a second container preheating means along the contact means, the first and the second container preheating means arranged to face with each other in parallel, each having a blowout face for preheating a portion of the container and arranged inclined with respect to the conveying direction of the container, the contact means is included in the first container preheating means and is arranged adjacent to the blowout face of the first container preheating means;

TABLE 1

| No. | Heating position | Temperature ° C. | Self-cooling | Existence of gap | PET | OPS ® |
|---|---|---|---|---|---|---|
| A | Small diameter portion 54' | 40 | No | Yes | Good | Good |
| B | Small diameter portion 54' | 70 | No | Yes | Good | Good |
| C | Large diameter portion 53 | 40 | No | Yes | Good | Good |
| D | Large diameter portion 53 | 70 | No | No | Good | Good |
| E | Large diameter portion 53 | 70 | Yes | No | Moderate | Good |
| F | Not heating | Normal temperature | No | Yes | Poor | Poor |

surrounding the container with the wrapping member; and heating the wrapping member by a wrapping member heating means at a temperature not less than a shrinkage starting temperature of the wrapping member so as to shrink the wrapping member around the container and attach the wrapping member to the container.

2. The wrapping member attaching method according to claim 1, further comprising the step of suppressing the container, which has been preheated by the first and the second container heating means, by a self-cooling suppressing means, from being self-cooled between the first and the second container preheating means and the wrapping member heating means.

3. A wrapping member attaching device for attaching a wrapping member to a container, comprising:

a first and a second container preheating means arranged to face with each other in parallel and each having a blowout face for preheating a portion of the container;

a wrapping member arranging means for arranging the wrapping member in such a manner that the container can be surrounded by the wrapping member;

a wrapping member heating means for heating the wrapping member to a temperature not less than a shrinkage starting temperature of the wrapping member so that the wrapping member can be shrunk around the container and attached to it; and a conveyer for conveying the container, the first and the second container preheating means, the wrapping member arranging means and the wrapping member heating means are arranged in this order in a conveying direction of the conveyer;

wherein the first and the second container preheating means are arranged being inclined with respect to the conveying direction of the conveyer in such a manner that the blowout face of the first container preheating means can be seen from the upstream side of the conveying direction of the conveyer;

wherein the first container preheating means includes a container rotating means for rotating the container, the container rotating means is a contact member which is arranged being adjacent to the blowout face of the first container preheating means; and wherein when the conveyer conveys the container, the container collides with the contact means to rotate in a circumferential direction of the container while entering a gap between the first and the second container preheating means along the contact means so that the container is preheated.

4. The wrapping member attaching device according to claim 3, further comprising a self-cooling suppressing means for suppressing the container, which has been preheated by the first and the second container preheating means, from being self-cooled between the first and the second container preheating means and the wrapping member heating means.

5. The wrapping member attaching device according to claim 4, wherein the container preheating means and/or the wrapping member heating means is a steam type heating device.

6. The wrapping member attaching device according to 4, wherein the container preheating means and/or the wrapping member heating means is a hot air type heating device.

7. The wrapping member attaching device according to claim 3, wherein the container preheating means and/or the wrapping member heating means is a steam type heating device.

8. The wrapping member attaching device according to claim 3, wherein the container preheating means and/or the wrapping member heating means is a hot air type heating device.

* * * * *